US005452696A

United States Patent [19]

Flynn

[11] Patent Number: 5,452,696

[45] Date of Patent: Sep. 26, 1995

[54] METHOD AND APPARATUS FOR CLEANING DEPOSITS AND RESIDUE FROM INTERNAL COMBUSTION ENGINES

[76] Inventor: Robert E. Flynn, 953 N. Greer Ave., Covina, Calif. 91724

[21] Appl. No.: 198,533

[22] Filed: Feb. 17, 1994

Related U.S. Application Data

[62] Division of Ser. No. 956,596, Oct. 5, 1992, Pat. No. 5,287,834, which is a continuation of Ser. No. 666,390, Mar. 8, 1991, abandoned.

[51] Int. Cl.[6] ..... F02B 77/00

[52] U.S. Cl. ..... 123/198 A; 134/169 A

[58] Field of Search ..... 123/198 A, 1 A; 134/169 A

[56] References Cited

U.S. PATENT DOCUMENTS

| | | | |
|---|---|---|---|
| 1,701,824 | 2/1929 | Robinson | 123/198 A |
| 3,094,131 | 6/1963 | Williams | 123/198 A |
| 4,494,487 | 1/1985 | Nixon | 123/198 A |
| 4,877,043 | 10/1989 | Carmichael et al. | 123/198 A |

*Primary Examiner*—Noah P. Kamen
*Attorney, Agent, or Firm*—Boniard I. Brown

[57] ABSTRACT

A method and apparatus for removing internal carbon deposits and related residue and contaminants from fuel injected and carbureted internal combustion engine systems by delivering fuel to the inlet of the engine fuel pump while the engine is cranked by battery power to start the engine and then delivering an engine conditioning fuel, which is a mixture of normal engine fuel and a carbon cleaning agent, to the fuel pump inlet so that the conditioning fuel passes through and removes carbon deposits from the engine fuel injectors or carburetor, as the case may be, and is then combusted in the engine cylinders to power the engine. The effectiveness of the carbon cleaning operation is determined by monitoring the flow rate of normal engine fuel to the engine.

4 Claims, 4 Drawing Sheets

METHOD AND APPARATUS FOR CLEANING DEPOSITS AND RESIDUE FROM INTERNAL COMBUSTION ENGINES

This is a divisional of application Ser. No. 07/956,596, filed on Oct. 5, 1992, now U.S. Pat. No. 5,287,834, which is a continuation of Ser. No. 07/666,390, filed on Mar. 8, 1991, now abandoned.

BACKGROUND OF THE INVENTION

1. Field of the Invention

This invention relates generally to internal combustion engines, such as those of automotive vehicles, and more particularly to novel engine conditioning apparatus and conditioning method for priming and cleaning internal carbon deposits and related residue and contaminants from such engines.

2. Prior Art

This invention is concerned with certain well known operating problems associated with internal combustion engines including both carbureted engines and fuel injected engines. One of these problems resides in the fact that during engine operation, deposits of carbon and related residue and contaminants, hereafter referred to simply as carbon deposits, form on the internal surfaces of the fuel handling means of such engines including the internal carburetor surfaces of carbureted engines and the internal fuel pump and fuel injector surfaces of fuel injected engines. Unless removed at regular intervals, these carbon deposits can build up sufficiently to seriously degrade engine performance and possibly even totally clog the fuel system and especially relatively small fuel passages in fuel injectors and carburetors.

Various engine conditioning procedures and systems have been devised for removing such internal carbon deposits from internal combustion engines. One known engine conditioning procedure, for example, involves disassembly of an engine and individual cleaning of the engine parts. This engine cleaning procedure is obviously complex, time consuming, costly, and requires the services of highly skilled personnel. Never-the-less, the procedure has one inherent advantage. This advantage resides in the fact that disassembly permits direct inspection of the engine parts and thereby accurate visual determination of their cleanliness. U.S. Pat. No. 4,787,348 discloses an alternative engine conditioning procedure which which involves the use of a carbon cleaning agent without disassembly of the engine or the services of highly skilled technicians. This procedure does not permit a determination of the effectiveness of the carbon cleaning operation.

Another problem to which internal combustion engines, particularly diesel engines and other fuel injected engines, are subject is absence or loss of prime, that is failure of the fuel system to deliver fuel to the engine cylinders due to the presence of air in the fuel passage. Such loss of prime occurs or is prone to occur under various circumstances, such as when an engine is initially put into service, if the fuel system runs out of fuel, if a fuel line is disconnected, or when a fuel line is disconnected to service a fuel filter or for some other reason.

Accordingly, there is a definite need for an improved engine conditioning method and apparatus for the purpose described which will clean carbon deposits from an engine fuel system including, especially, the fuel injectors of a fuel injected engine and the carburetor of a carbureted engine. Since use of the conditioning apparatus will require disconnection of a fuel line and thus result in loss of engine prime, the conditioning apparatus should also be capable of priming the engine at the start and after completion of the cleaning procedure.

SUMMARY OF THE INVENTION

This invention provides such an improved engine conditioning method and apparatus. The improved conditioning apparatus may be used to either or both remove internal carbon deposits from the fuel handling means of an internal combustion engine, including particularly the fuel injectors of a fuel injected engine and the carburetor of a carbureted engine, and to prime the engine. The invention cleans carbon deposits from an internal combustion engine by introducing a combustible carbon cleaning conditioning fuel containing a carbon removing agent into the engine while it is operating in such a way that the conditioning fuel flows through and cleans internal carbon deposits from the engine fuel handling means, including, particularly, its fuel pump and fuel input means, i.e. fuel injectors or carburetor, after which the conditioning fuel is introduced into and combusted in the engine cylinders to power the engine.

A feature of this engine conditioning invention resides in its unique use of a fuel flow meter to determine the effectiveness of the carbon cleaning operation, that is the cleanliness of the internal engine fuel handling surfaces, without direct viewing of these surfaces which would require disassembly of the fuel system. According to another feature of the invention, the engine conditioning apparatus includes a priming pump for priming an internal combustion engine with engine fuel only or with the combustible, carbon cleaning conditioning fuel by feeding the engine fuel or conditioning fuel, as the case may be, through the fuel infeed line to the engine fuel pump.

The preferred engine conditioning apparatus of the invention disclosed herein is designed for use with an internal combustion engine of the kind whose fuel pump delivers fuel at a rate exceeding the total fuel inflow rate into the engine cylinders. A portion of the fuel output from the fuel pump is excess fuel which is utilized to cool and lubricate the fuel pump and the fuel input means, i.e. fuel injectors or carburetor, as the case may be, and is then recycled back to the engine. The diesel engine system described in my U.S. Pat. No. 4,479,465 is such an engine system. In this patented engine system, the recycled excess fuel from the engine is combined, within a fuel relay valve or manifold, with incoming fresh fuel from the engine fuel tank.

The preferred engine conditioning apparatus comprises fuel handling means for receiving either pure engine fuel or a pre-mixed, combustible carbon cleaning conditioning fuel mixture of engine fuel and carbon cleaning agent, means for dispensing the carbon cleaning agent into the fuel handling handling system when it contains only pure engine fuel to form the engine conditioning fuel, a priming pump, and means for releasably connecting the fuel handling means of the conditioning apparatus to the fuel handling means of an internal combustion engine to be conditioned in such a way that the priming pump is operable to initially pump fuel from the apparatus fuel handling means to the engine to start the engine after which the engine fuel pump pumps the conditioning fuel through the engine. During its passage through the engine, the conditioning fuel flows through and cleans internal carbon deposits from the engine fuel input means, i.e. fuel injectors or carburetor, as the case may be. The fuel then enters and is combusted in the engine cylinders to power the engine. In the case of an engine whose fuel pump delivers excess fuel for cooling and lubricating the fuel input means, the excess fuel is returned to the fuel receiver and then recycled back to the engine.

A unique feature of the invention resides in the use of a fuel flow meter to determine the effectiveness of the carbon cleaning operation, that is the internal cleanliness of the engine fuel system, without visual inspection of the cleaned surfaces by measuring the flow rate of pure engine fuel to the engine and thereby the actual engine fuel consumption (not conditioning fuel consumption). The priming pump of the conditioning apparatus is used to prime the engine with either pure engine fuel or the conditioning fuel at the start of the conditioning operation and may be used to later prime the engine for normal operation.

In one disclosed embodiment of the invention, fuel handling means of the engine conditioning apparatus comprises a fuel relay valve or manifold like that disclosed in my above mentioned U.S. Pat. No. 4,479,465 through which both recycled excess fuel from the engine and fresh fuel from the engine fuel tank flow to the engine. Mounted on this manifold is a container for containing a carbon cleaning agent and dispensing a precisely measured quantity of this agent into the fuel flowing through the manifold to form the combustible carbon cleaning conditioning fuel.

In another disclosed embodiment, the conditioning apparatus fuel handling means comprises a conditioning fuel tank for containing an initial quantity of the conditioning fuel and through which excess fuel is recycled back to the engine being conditioned. A feature of this embodiment resides in a selector valve for selectively connecting the conditioning fuel tank to the engine fuel tank for the purpose of initially transferring engine fuel from the engine fuel tank to the conditioning fuel tank and connecting the conditioning fuel tank to the excess fuel return line of the engine for recycling excess fuel from the engine through the conditioning fuel tank back to the engine.

It will become evident as the description proceeds that the engine conditioning apparatus of the invention can be incorporated as a permanent part of an engine system. The preferred conditioning apparatus, however, is a separate external apparatus which is connected to an engine system only during conditioning of the engine and then disconnected from the engine system. The disclosed embodiments of the invention are of this kind.

DESCRIPTION OF THE PREFERRED EMBODIMENT

Figure 1:
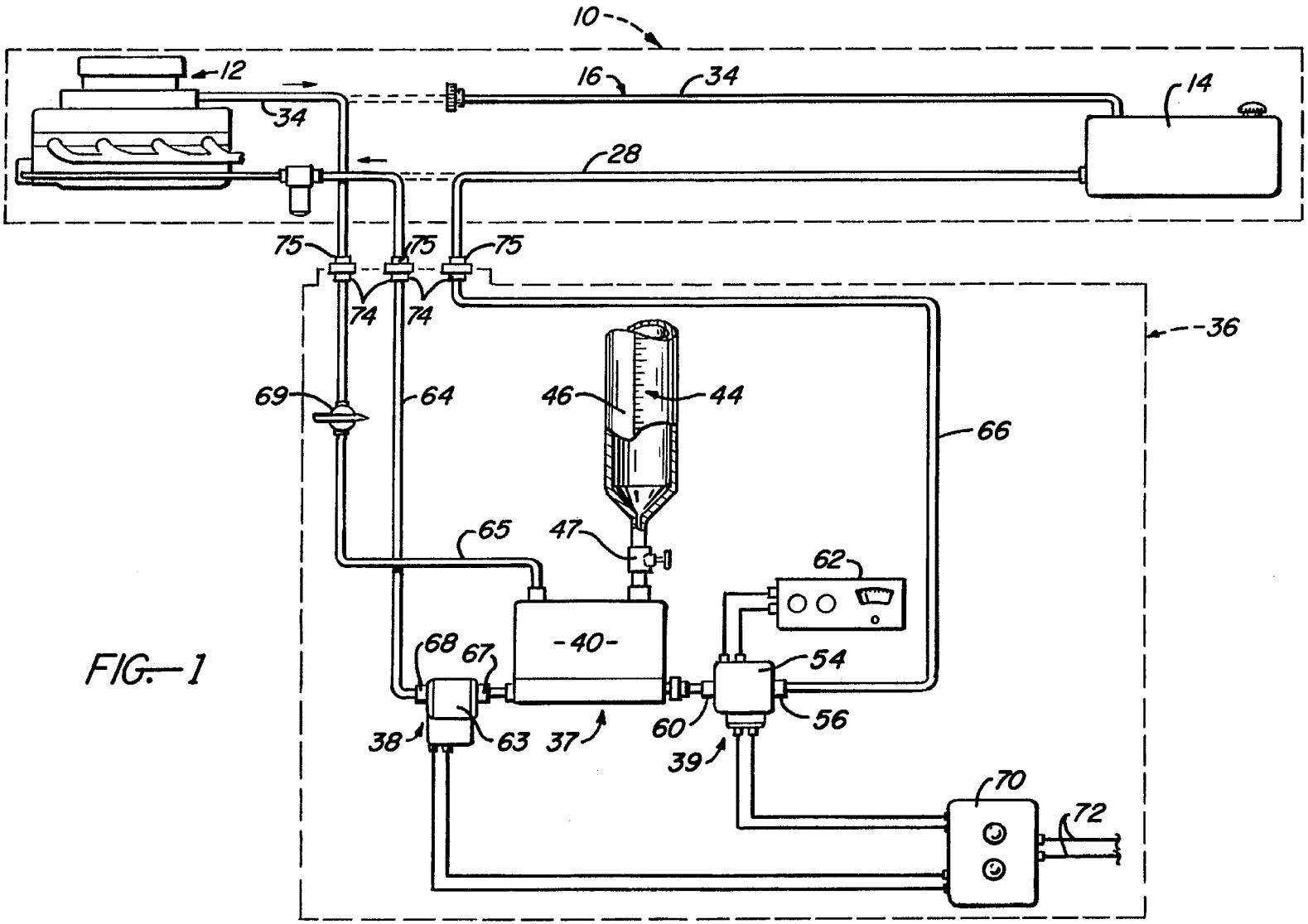
FIG. 1 diagramatically illustrates an engine conditioning apparatus according to the invention operatively coupled to an internal combustion engine system.
Figure 2:
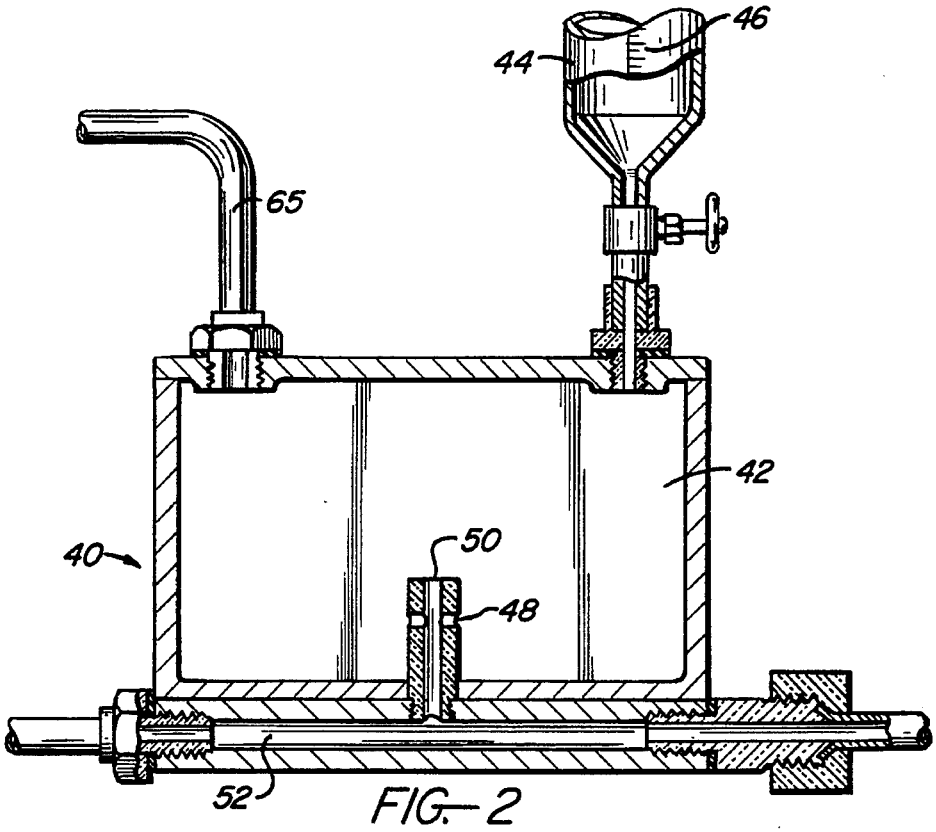
FIG. 2 is an enlarged section through a relay valve or manifold embodied in the conditioning apparatus of FIG. 1.
Figure 2A:
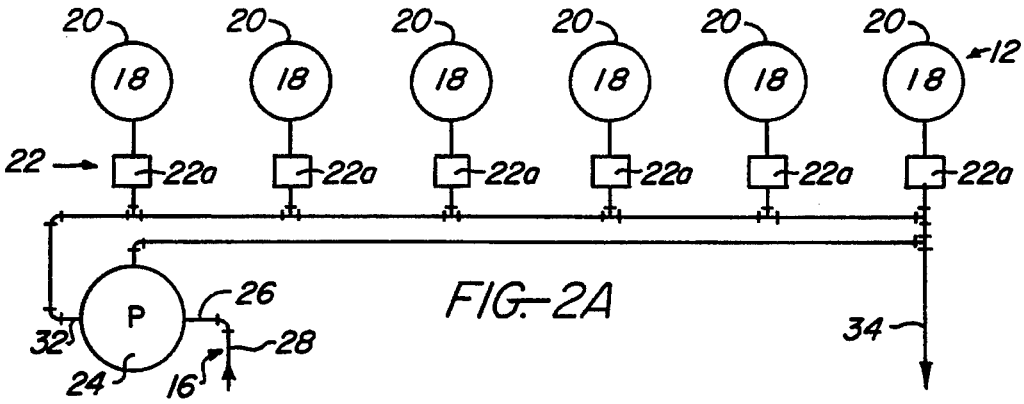
FIG. 2A diagramatically illustrates the engine of FIG. 1 as a fuel injected engine.
Figure 2B:
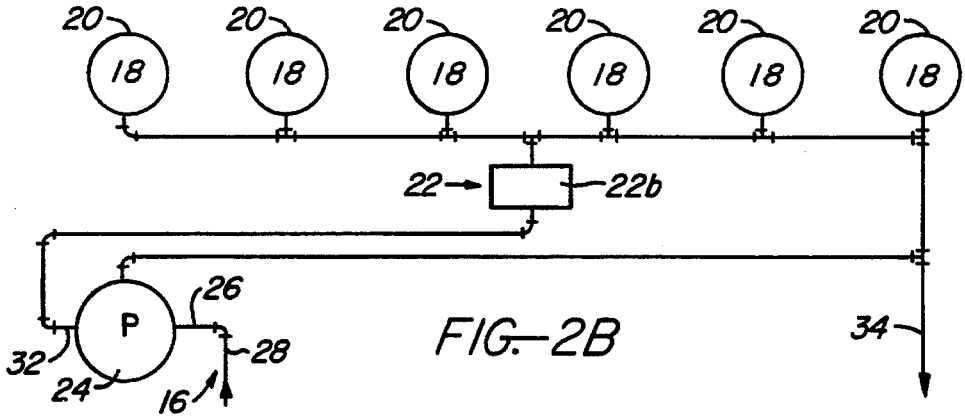
FIG. 2B diagramatically illustrates the engine of FIG. 1 as a carbureted engine.

Turning now to these drawings and first to FIGS. 1–2B, there is illustrated a conventional internal combustion engine system 10 including an internal combustion engine 12, a fuel tank 14 for containing engine fuel which normally powers the engine, and fuel handling means 16 for feeding fuel from the fuel tank 14 to the combustion chambers 18 of the engine cylinders 20. The engine 12 may be either a fuel injected engine, as illustrated in FIG. 2A, or a carbureted engine, as illutrated in FIG. 2B. In either case, one portion of the fuel handling means is embodied directly in the engine. This portion of the fuel handling means includes fuel input means 22 for introducing fuel into the engine cylinders 20 and a fuel pump 24 for feeding fuel at the proper pressure to the fuel input means. Fuel pump 24 has an inlet 26 normally connected to the fuel tank 14 through a fuel infeed line 28 containing a fuel filter 30, and a fuel outlet 32 connected to the fuel input means 22. During normal engine operation, the fuel pump 24 pumps fuel from the fuel tank 14 to the fuel input means 22 which then introduces the fuel into the engine cylinders 20. In a fuel injected engine, the fuel input means 22 comprise fuel injectors 22*a* (FIG. 2A) which inject fuel at high pressure into the individual engine cylinders. In a carbureted engine, the fuel input means 22 comprises a carburetor 22*b* (FIG. 2B) which atomizes the fuel and mixes the atomized fuel with the intake air entering the cylinders.

The fuel injection system illustrated in FIG. 2A is a conventional system which utilizes fuel to both power the engine and cool and lubricate the fuel pump and fuel injectors 22*a*. In this case, the fuel injection pump 24 operates continuously to pump fuel at a rate which exceeds the fuel infeed rate through the fuel injectors 22*a* into the engine cylinders 20. Accordingly, a portion of the fuel output from the pump is excess fuel. This excess fuel cools and lubricates the fuel pump and fuel injectors and is then recycled back through the fuel handling means 16. The carbureted fuel handling means in FIG. 2B is a conventional system of the kind which utilizes fuel to both power the engine and cool the carburetor 22*b*. The excess fuel is recycled back through the fuel handling means in much the same way as in a fuel injected engine.

From the above discussion, it will be understood that the engine system 10 illustrated in FIG. 1 is a fuel recirculating engine system in which the pumping rate of the fuel pump 24 exceeds the rate of fuel delivery to the engine cylinders 20 so that the pump discharges excess fuel. The engine fuel handling means includes an excess fuel return line 34 through which this excess fuel is returned to the fuel tank 14. During normal operation of this engine system, the fuel pump 24 pumps fuel from the fuel tank 14 to the fuel input means 22 (i.e. either fuel injectors 22*a* or carburetor 22*b*) which introduce(s) the fuel into the engine cylinders 20. The excess fuel output from the pump returns to the fuel tank 14 through the fuel return line 34.

Simply stated, the present invention provides apparatus for conditioning the engine 12 by either or both (a) priming the engine with normal engine fuel or an engine conditioning fuel comprising a mixture of engine fuel and a carbon removing agent in order to start the engine, and (b) feeding the conditioning fuel to the engine while it is running in such a way as to both remove internal carbon deposits from the engine, particularly its fuel input means 22 (fuel injectors 22*a* or carburetor 22*b*) and power the engine. Among the preferred carbon cleaning agents are glycol ether EB, aromatic solvent blend, ammonia soaps, petroleum distillates, and alcohol derivatives.

The engine conditioning apparatus 36 illustrated in FIGS. 1 and 2 comprises fuel handling means 37 for separately receiving the normal engine fuel and the carbon cleaning agent which mix within the fuel handling means to form a combustible engine conditioning fuel capable of combustion in the engine 12. The apparatus fuel handling means 37 is adapted to be connected to the engine fuel handling means 16 in such a way as to permit fuel flow between the two fuel handling means. The apparatus fuel handling means comprises fuel transport means 38 for feeding normal engine fuel from the engine fuel tank 14 to the engine 12 to initially start the engine and then circulating the conditioning fuel through the engine to both remove carbon deposits from and power the engine. Also included in the apparatus fuel handling means 37 is a fuel flow meter 39 for measuring the flow rate of normal engine fuel (not conditioning fuel) to the engine. The rate of consumption of normal engine fuel by the engine 12 decreases as carbon deposits are removed from the engine. The flow meter 39 is used to measure this reduction in normal fuel consumption and thereby guage the effectiveness of the carbon removing operation without the necessity of disassembling the engine to permit visual inspection of the internal engine surfaces.

Referring now in more detail to the engine conditioning apparatus 36 of FIG. 1, its fuel handling means 37 comprises a fuel relay valve or manifold 40 like that described in my U.S. Pat. No. 4,479,465 except for the difference mentioned below. Within this manifold is a chamber 42 which is connected to the excess fuel return line 34 of the engine 12 so that excess fuel from the engine fuel pump 24 is conducted to the manifold chamber. Removably mounted on the top wall of the manifold is a refillable container 44 for receiving the carbon cleaning agent which is used in the conditioning apparatus and dispensing this agent into the chamber 42 for mixing with the excess fuel passing through the chamber to form the conditioning fuel. This agent dispensing container has a graduated scale 46 and a valved spigot 47 and provides a metering means for metering a precise quantity of the agent into the chamber. At the bottom of the manifold chamber 42 is an upstanding tube 48 containing a passage 50 which communicates the chamber to a normal fuel infeed passage 52 extending through the bottom of the manifold below the chamber. Except for the means for mounting the agent dispensing container 44 on its top wall, the manifold 40 is identical to that described in my above U.S. Pat. No. 4,479,465.

The fuel flow meter 39 comprises an electrical flow transducer 54 having an inlet 56 and an outlet 60. The transducer outlet 60 is connected to one end of the manifold fuel infeed passage 52. During operation of the conditioning apparatus 36, normal engine fuel flows from the engine fuel tank 14, through the transducer 54 and manifold passage 52, to the engine 12. Transducer 54 is electrically connected to a readout device 62 which displays the rate of this normal engine fuel flow through the transducer.

The fuel transport means 38 comprises a priming pump 63 and three fuel lines 64, 65, 66. The priming pump 63 has an inlet 67 and an outlet 68. The priming pump inlet 67 is connected to the end of the manifold fuel infeed passage 52 opposite the flow transducer 54. One end of the fuel line 64 is connected to the priming pump outlet 68. Fuel line 65 contains a shutoff valve 69 and is connected at one end to the top wall of the relay manifold 40. This end of fuel line 65 opens to the manifold chamber 42. One end of the fuel line 66 is connected to the transducer inlet 56. The priming pump 63 and fuel flow meter 39 are electrically connected to a switch 70 having leads 72 for connection to a suitable electrical power source, such as the electrical system of the engine 12 being conditioned, for energizing the priming pump and flow meter.

The apparatus fuel handling means 37 including the priming pump 38, manifold 40, flow meter 39, agent dispensing container 44, fuel lines 64, 65, 66, and switch 70 constitute a unitary engine system conditioning apparatus 36 which is external to the engine system 10. This conditioning apparatus is designed to be quickly and easily connected to the engine system in the manner shown in solid lines in FIG. 1 and just as quickly and easily disconnected from the engine system. To this end, the conditioning apparatus fuel lines 64, 65, 66 mount coupling parts 74 which are adapted to mate with coupling parts 75 on the engine system fuel lines 28, 43 to releasably connect the engine system and conditioning apparatus fuel lines to one another in the manner shown in solid lines in FIG. 1. In this regard, it will be observed that the conditioning apparatus fuel line 64 comprises a priming pump discharge line which is connected to the inlet 26 (FIGS. 2A, 2B) of the engine system fuel pump 24 through a downstream portion of the engine system fuel infeed line 28 and the fuel filter 30. The conditioning apparatus fuel line 65 comprises an excess fuel return line which is connected to the engine system excess fuel return line 43. The conditioning apparatus fuel line 66 comprises a normal engine fuel transfer line which is connected to the fuel engine tank 14 through an upstream portion of the engine system fuel infeed line 28. When the conditioning apparatus 36 is detached from the engine system 10, the engine system fuel lines 28, 43 are reconnected in the manner illustrated in broken lines in FIG. 1 for normal operation of the engine system.

The engine conditioning apparatus 36 is readied for operation by filling the agent dispensing container 44 with the desired carbon cleaning agent, mounting the filled container on the manifold 40, and connecting the conditioning apparatus fuel lines 64, 65, 66 to the engine system 10 in the manner described above and shown in solid lines in FIG. 1. The shutoff valve 69 in the excess fuel return lines 43, 65 is then closed, and the engine 12 is cranked by battery power while the conditioning apparatus priming pump 63 is operated to pump normal engine fuel from the fuel tank 14 to the engine through the upstream portion of the engine system fuel infeed line 28, then through the fuel transfer line 66, flow transducer 54, relay manifold fuel infeed passage 52, priming pump 63, and priming pump discharge line 64 of the conditioning apparatus, and finally through the downstream portion of the fuel infeed line 28 and filter 30 to the inlet 26 of the engine fuel pump 24 to start the engine. When the engine 12 starts, the priming pump 63 may be stopped, and the engine fuel pump 24 pumps fuel from the fuel tank 14, through the conditioning apparatus 36, to the engine. The valve 69 is now opened to permit flow of excess fuel from the engine fuel pump 24 through the fuel return lines 43, 65 into the chamber 42 in the relay manifold 40 and then from this chamber through the manifold passage 50 into the manifold fuel infeed passage 52. This recycled excess fuel mixes with the incoming fresh normal engine fuel entering the apparatus through the infeed passage and is returned to the engine 12.

A measured quantity of carbon removing agent is now dispensed from the container 44 into the manifold chamber 42. This agent mixes with the recycled excess fuel flowing through the chamber to form a combustible carbon removing, engine conditioning fuel which is fed to the engine 12.

This conditioning fuel passes through and removes internal carbon deposits from the fuel pump 24 and fuel input means 22 (fuel injectors 22*a* or carburetor 22*b*) and is then combusted in the engine 12 to run the engine. The conditioning fuel also cools and lubricates the fuel input means 22 and fuel pump 24. The excess conditioning fuel output from the engine fuel pump 24 is recycled back to the engine through the manifold 40.

The engine conditioning apparatus 36 is operated for a certain period of time which has been found to produce the desired carbon-free condition of an engine. This operating period may be timed by any suitable timer (not shown) external to or incorporated in the apparatus. The timer may include an alarm for signaling completion of the cleaning operation. If neccessary, additional carbon cleaning agent may be added to the fuel during the conditioning operation. As the carbon deposits are progressively removed from the engine, the rate of consumption of normal engine fuel from the engine fuel tank 14 decreases. This decrease can be measured by the flow meter 39 to determine the effectiveness of the engine conditioning operation.

It is evident from the foregoing description that the fuel line 66, provides a normal fuel and form a fuel infeed passage in the apparatus through which normal engine fuel flows from the engine fuel tank 14 to one end of the manifold infeed passage. Fuel line 65, the manifold chamber 42, and manifold passage 50 together form an excess fuel return passage through which excess fuel flows from the engine 12 to the infeed passage 52 at a passage junction located between the upstream and downstream ends of the latter passage. The excess from the engine 12 and the incoming fresh normal engine fuel from the engine fuel tank mix within the fuel infeed passage 52 and flow through this passage to the priming pump inlet 67. The manifold 40 also serves as a conditioning fuel tank into whose chamber 42 a carbon cleaning agent may be metered by the metering means 44 for mixing with normal engine fuel flowing through the chamber. This mixture then mixes further with the normal engine fuel entering the infeed passage 52 from the engine fuel tank through the fuel transfer line 66 to form a combustible engine conditioning fuel which circulates through and cleans carbon from the engine 12.

The engine conditioning apparatus 36 can be used to simply prime an engine by operating the priming pump 63 with or without dispensing carbon removing agent into the engine fuel. When thus priming an engine, the priming pump will be operated until the engine system fuel lines and filter are filled with fuel and the engine system can operate on its own. In either case, the priming pump fills the engine system fuel lines and fuel filter 30 with sufficient fuel to enable the engine to start and continue running after the engine system is restored to its normal operating condition.

Figure 3:
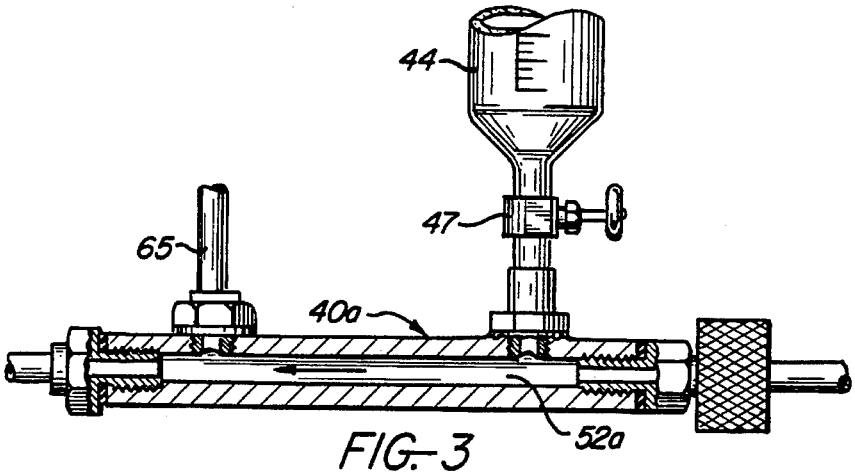
FIG. 3 is a section through a modified fuel relay valve or manifold for the conditioning apparatus of FIG. 1.

The modified fuel manifold 40*a* of FIG. 3 can be used in the engine conditioning apparatus of the invention in place of the fuel manifold 40. The only essential differences between the two manifolds are as follows: the mixing chamber 42 in manifold 40 is eliminated in the manifold 40*a;* the fuel return line 65 of the conditioning apparatus opens directly into the manifold fuel infeed passage 52*a;* and the cleaning agent dispensing container 44 which forms a dispensing means for dispensing carbon cleaning agent directly into the manifold fuel infeed passage 52*a* upstream along the latter passage from the junction of the infeed passage and the fuel return line 65.

Figure 4:
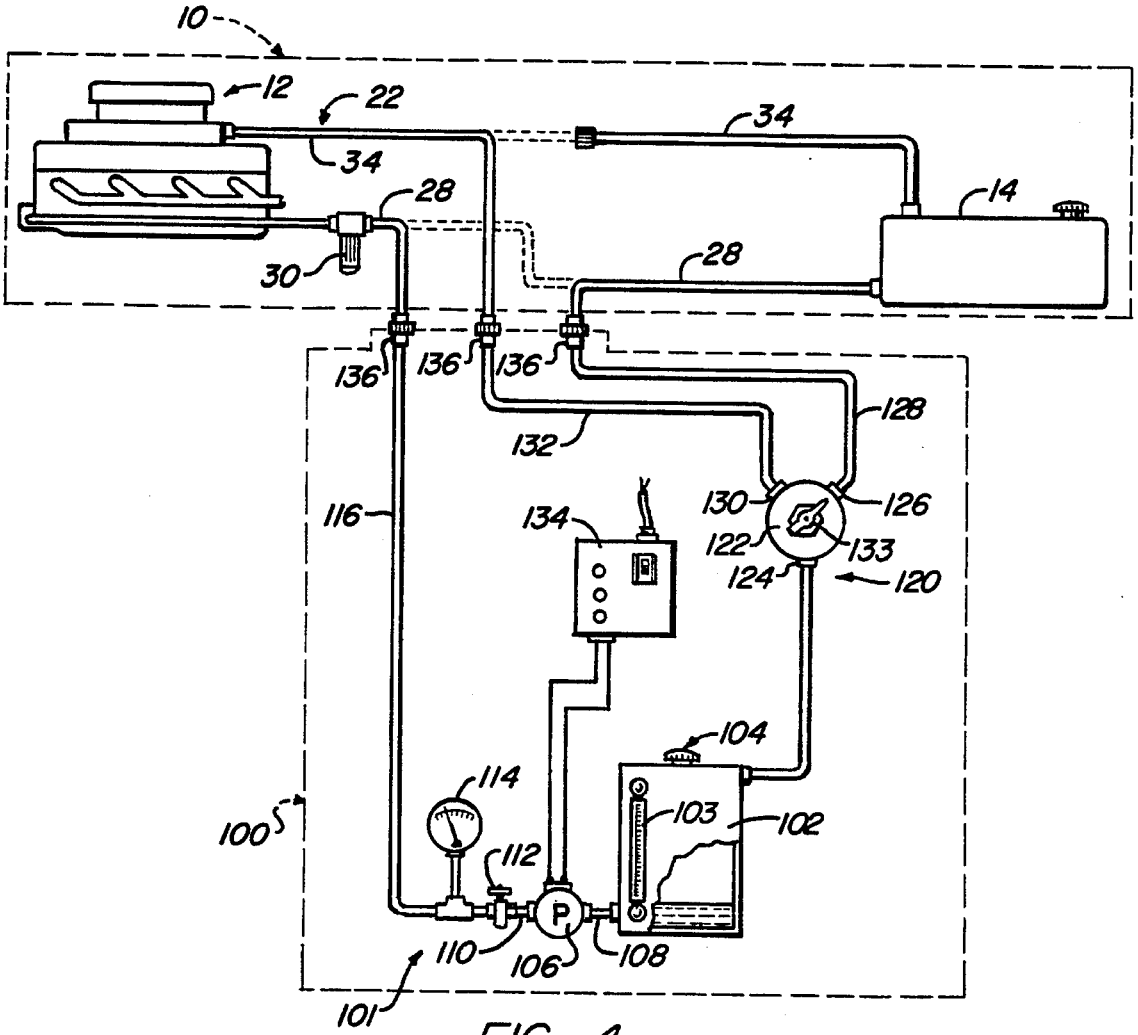
FIG. 4 diagramatically illustrates a modified engine conditioning apparatus according to the invention.

FIG. 4 illustrates a modified engine system conditioning apparatus 100 according to the invention connected to an engine system 10 identical to the engine system in FIG. 1. The modified conditioning apparatus 100 comprises fuel handling means 101 including a tank 102 for containing a conditioning fuel like that discussed in connection with FIGS. 1–3. In the particular conditioning apparatus 100 illustrated, the carbon removing agent is introduced into the conditioning fuel tank 102 through a filler opening 104 in the top of the tank. Normal engine fuel is transferred to the tank from the engine system fuel tank 14 in the manner explained below. The tank has a graduated sight glass 103 for use in filling the tank.

A priming pump 106 has an inlet 108 connected to the bottom of the conditioning fuel tank 102 and an outlet 110 connected through a pressure regulator 112 and a pressure gauge 114 to a priming pump fuel discharge line 116 to be connected to the inlet 26 of the engine fuel pump 24 (FIGS. 2A, 2B). Also connected to the tank 102 are means 120 for selectively connecting the tank to the engine system fuel tank 14 and to the engine system fuel return line 34. Means 120 comprises a selector valve 122 having an outlet 124 connected to the tank 102, a first inlet 126 connected to a fuel transfer line 128, a second inlet 130 connected to a fuel return line 132, and internal valve means (not shown) operable by a valve handle 133. The valve is selectively operable to a closed position to block flow through the valve, to a fuel transfer position wherein the fuel transfer line 128 communicates with the tank 102, and an engine conditioning position wherein the fuel return line 132 communicates with the tank. Priming pump 106 is connected to an electrical power source, such as the engine electrical system, through a switch 134 for selectively operating the the pump. While the illustrated selector valve 122 is manually operated, it may be a solenoid valve operable by the switch 134.

During normal operation of the engine system 10, its fuel lines 28, 34 are connected in the manner illustrated by the broken lines in FIG. 4 to connect the engine 12 to engine system fuel tank 14. During use of the conditioning apparatus 100 to condition the engine, the apparatus fuel lines 116, 128, 132 are connected by releasable couplings 136 to the engine system in the manner shown in solid lines in FIG. 4. In this regard, it will be seen that the priming pump fuel discharge line 116 is connected to the inlet 26 of the engine fuel pump 24 (FIGS. 2A, 2B), the fuel transfer line 128 is connected to the engine system fuel infeed line 28 extending to the fuel tank 14, and the fuel return line 132 is connected to the engine system excess fuel return line 34.

The selector valve 122 in the conditioning apparatus 100 is initially placed in its fuel transfer position to connect the conditioning fuel tank 102 to the engine system fuel tank 14. The priming pump 106 is then operated while the engine 12 is cranked by its battery to pump normal engine fuel from the engine system fuel tank 14 to the engine 12 to fill the latter tank with normal engine fuel from the engine system fuel tank and start the engine. When the engine starts, the priming pump 106 is stopped, and the selector valve 122 is operated to its engine conditioning position to connect the conditioning fuel tank 102 to the engine system fuel return line 34. Excess fuel output from the engine fuel pump 24 then flows from the engine to the tank 102, while fuel flow occurs from this tank back to the engine. Fuel thus recirculates through the receiving tank and engine.

A measured quantity of carbon cleaning agent is introduced into the conditioning fuel tank 102 through its filler opening 104 before, during, or after the above fuel transfer to the tank 102 to form the desired combustible conditioning fuel. This conditioning recirculates through and thereby cools and lubricates the engine fuel pump 24 and the engine fuel injectors 22*a* or carburetor 22*b*, as the case may be, and is then fed into the engine cylinders 20 to power the engine.

The engine conditioning apparatus 100 of FIG. 4, like that of FIGS. 1–3, is operated for a period of time which has been found to produce the desired carbon free condition of the engine being conditioned. This operating period may be timed by an suitable timer (not shown) external to or incorporated in the apparatus and may include an alarm for signaling completion of the cleaning operation. In contrast to the engine conditioning apparatus of FIGS. 1–3, which continuously receives normal engine fuel from the fuel tank 14 during its conditioning operation, the conditioning apparatus of FIG. 4 operates with an initially fixed quantity of conditioning fuel which is progressively consumed. The receiving tank 102 is preferably sized to hold a sufficient quantity of conditioning fuel for the particular conditioning period over which the apparatus is intended to operate. If desired or neccessary, of course, the conditioning fuel may be replenished by positioning the valve 122 to reconnect the receiving tank to the fuel tank 14 for a short period of time in order to transfer additional normal engine fuel to the receiving tank. Additional carbon cleaning agent may also be introduced into the receiving tank along with, or without, the transfer of more fuel to the tank. The conditioning apparatus 100 can be operated as described above to simply prime an engine using either the conditioning fuel or normal engine fuel.

Figure 5:
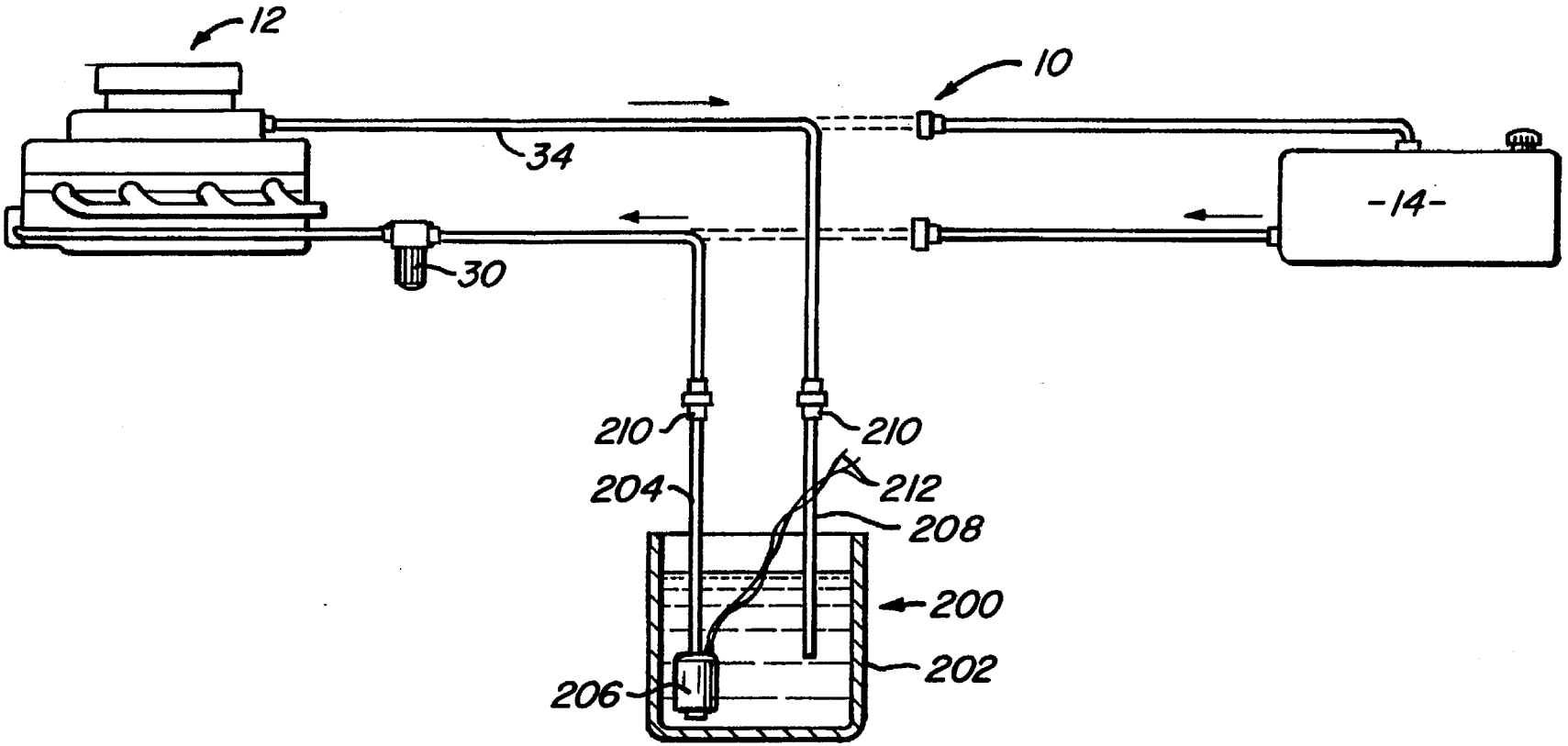
FIG. 5 illustrates a further modified engine conditioning apparatus according to the invention.

FIG. 5 illustrates a much simplified engine conditioning apparatus 200 according to the invention. This apparatus comprises a disposable container 202 containing engine conditioning fuel, a fuel discharge line 204 connected to the outlet of a submersible priming pump 206 to be lowered to the bottom of the container, and a fuel return line 208 to be inserted at one end into the container. On the opposite ends of the apparatus fuel lines 204, 208 are couplings 210 for releasably connecting the priming pump discharge fuel line 204 to the inlet 26 of the engine fuel pump 24 and connecting the apparatus fuel return line 208 to the engine excess fuel return line 34, as shown. The priming pump 206 has leads 212 for connection to an electrical power source, such as the electrical system of the engine to cleaned. Engine conditioning fuel may be provided in the container 202 by either premixing the conditioning fuel and then introducing the premixed fuel into the container or introducing normal engine fuel and carbon removing agent into the container for mixing within the container.

Operation of the engine conditioning apparatus 200 is essentially the same as that of conditioning apparatus 100 in FIG. 4 except for omission of the fuel transfer feature of the latter apparatus. When the conditioning fuel in the container 202 is all consumed, the container may be disposed of. Additional conditioning of an engine, if neccessary, or conditioning of a different engine is accomplished by either refilling an empty used container with conditioning fuel or using a new container filled with conditioning fuel.

While the invention has been described in connection with conditioning a fuel recycling engine system which utilizes excess fuel output from an engine fuel pump to lubricate and/or cool the engine fuel input means, such as fuel injectors or a carburetor, and then recycles such excess fuel output, the invention may be utilized to condition a non-fuel-recycling engine system in which essentially all of the fuel delivered to the engine is fed into the engine cylinders. The shutoff valve in the engine system fuel return line 34 can be used to adjust the fuel return flow in order to obtain the correct of mixture of cleaning agent, infeed fuel flow, and infeed fuel flow in the conditioning apparatus of FIGS. 1–3.

I claim:

1. In combination:

an internal combustion engine having combustion chamber means, fuel input means for introducing fuel into said combustion chamber means to power the engine, an engine fuel pump for pumping fuel to said fuel input means at a pumping rate which exceeds the fuel flow rate through said fuel input means into said combustion chamber means, an excess fuel return line, and wherein said fuel pump has an inlet for receiving fuel and an outlet connected to said fuel input means and to said excess fuel return line, and a portion of the fuel output from the engine fuel pump is introduced into said combustion chamber means to power the engine and the remainder of the fuel output from said fuel pump constitutes excess fuel which is recycled back to the engine through said excess fuel return line during normal engine operation, engine conditioning apparatus comprising a container having a normally upper open side for containing fuel which may be either of the following fuels: (a) normal engine fuel, (b) a combustible carbon removing engine conditioning fuel, a submersible pump within said container having an inlet opening to the interior of the container and an outlet, an apparatus excess fuel return line accessible through said open side of said container and having one end releasably connected to said engine excess fuel return line and an opposite end opening into said container, and a fuel discharge line accessible through said open side of said container and connected at one end to said submersible pump outlet and releasably connected at its other end to said engine fuel pump inlet, and wherein said submersible pump, said discharge line, and said apparatus excess fuel return line are each devoid of permanent connection to said container and are freely insertable into and removable from said container through said open side of the container, and said apparatus is operable to perform at least one of the following functions: (a) pump normal engine fuel from said container to said engine during cranking of the engine to start the engine, and (b) pump engine conditioning fuel from said container to the running engine for removing carbon from the engine.

2. The combination according to claim 1, wherein:

said container is a free standing disposable container which may be discarded after removal of said of said submersible pump and said discharge line from the container.

3. In combination:

an internal combustion engine having combustion chamber means, fuel input means for introducing fuel into said combustion chamber means to power the engine, and an engine fuel pump having an outlet connected to said fuel input means and an inlet, engine conditioning apparatus comprising a container having a normally upper open side for containing engine fuel which may be either of the following fuels: (a) normal engine fuel, (b) a combustible carbon removing engine conditioning fuel, a submersible pump within said container having an inlet opening to the interior of the container and an outlet, and a fuel discharge line having one end connected to said submersible pump outlet and and opposite end accessible through said open side of said container and releasably connected to said engine fuel pump inlet, and wherein said submersible pump and said discharge line are each devoid of permanent connection to said container and are freely insertable into and removable from said container through said open side of the container, and said apparatus is operable to perform at least one of the following functions: (a) pump normal engine fuel from said container to said engine during cranking of the engine to start the engine, and (b) pump engine conditioning fuel from said container to the running engine for removing carbon from the engine.

4. The combination according to claim 3, wherein:

said container is a free standing disposable container which may be discarded after removal of said submersible pump and said discharge line from the container.

* * * * *